US008102968B2

(12) United States Patent
Nose et al.

(10) Patent No.: US 8,102,968 B2
(45) Date of Patent: Jan. 24, 2012

(54) HIGH BRIGHTNESS X-RAY GENERATING DEVICE AND METHOD

(75) Inventors: Hiroyuki Nose, Tokyo (JP); Daisuke Ishida, Tokyo (JP); Namio Kaneko, Tokyo (JP); Yasuo Sakai, Tokyo (JP); Mitsuru Uesaka, Tokyo (JP); Fumito Sakamoto, Tokyo (JP); Katsuhiro Dobashi, Tokyo (JP)

(73) Assignees: IHI Corporation, Tokyo (JP); The University of Tokyo, Tokyo (JP)

( * ) Notice: Subject to any disclaimer, the term of this patent is extended or adjusted under 35 U.S.C. 154(b) by 0 days.

(21) Appl. No.: 12/667,509

(22) PCT Filed: Jul. 1, 2008

(86) PCT No.: PCT/JP2008/061904

§ 371 (c)(1),
(2), (4) Date: Dec. 31, 2009

(87) PCT Pub. No.: WO2009/005059

PCT Pub. Date: Jan. 8, 2009

(65) Prior Publication Data

US 2011/0013749 A1 Jan. 20, 2011

(30) Foreign Application Priority Data

Jul. 3, 2007 (JP) ..... 2007-175180

(51) Int. Cl.
*H05G 2/00* (2006.01)

(52) U.S. Cl. ..... 378/119

(58) Field of Classification Search ..... 378/119, 378/121, 136, 137, 145, 143
See application file for complete search history.

(56) References Cited

U.S. PATENT DOCUMENTS

| | | | | |
|---|---|---|---|---|
| 6,377,651 | B1 * | 4/2002 | Richardson et al. | 378/34 |
| 6,687,333 | B2 * | 2/2004 | Carroll et al. | 378/119 |
| 7,372,056 | B2 * | 5/2008 | Bykanov et al. | 250/504 R |
| 7,382,861 | B2 * | 6/2008 | Madey et al. | 378/119 |

FOREIGN PATENT DOCUMENTS

| | | |
|---|---|---|
| JP | 07-110400 | 4/1995 |
| JP | 11-142786 | 5/1999 |

(Continued)

OTHER PUBLICATIONS

International Search Report, issued in corresponding application No. PCT/JP2008/061904, completed Aug. 5, 2008, mailed Aug. 19, 2008.

(Continued)

*Primary Examiner* — Irakli Kiknadze
(74) *Attorney, Agent, or Firm* — Griffin & Szipl, P.C.

(57) ABSTRACT

A high brightness X-ray generator and a high brightness X-ray generating method are provided which are able to promote an increase in X-ray brightness (i.e., an increase in an X-ray output) while suppressing an excessive increase in the cost of optical elements such as a laser unit, a mirror, and a lens. A high brightness X-ray generator generates an X-ray by inverse Compton scattering by colliding an electron beam with pulse laser light. There are provided a plurality of pulse laser units (32A, 32B) which emits a plurality of pulse laser lights (3a, 3b ) in predetermined periods, an optical-path matching unit (34) which matches optical paths of the plurality of pulse laser lights, and a timing control unit (40) which controls timings of the optical-path matching unit and the pulse laser units, wherein the plurality of pulse laser lights is emitted from the same optical path at different timings.

6 Claims, 5 Drawing Sheets

FOREIGN PATENT DOCUMENTS

| | | | |
|---|---|---|---|
| JP | 2001-338796 | A | 12/2001 |
| JP | 2001-345503 | | 12/2001 |
| JP | 2002-011584 | | 1/2002 |
| JP | 3463281 | | 11/2003 |
| JP | 2004-226271 | | 8/2004 |
| JP | 2004-227952 | | 8/2004 |
| JP | 2005-285764 | | 10/2005 |
| JP | 2006-318745 | | 11/2006 |
| JP | 2006-318746 | | 11/2006 |
| JP | 2006-344731 | | 12/2006 |
| WO | 2006/121126 | A1 | 11/2006 |

OTHER PUBLICATIONS

Yasuo Suzuki et al., A New Laser Mass Spectrometry for Chemical Ultratrace Analysis Enhanced with Multi-Mirror System (RIM-MPA), Analitical Science; 2001, vol. 17 Supplement.

International Search Report, issued in corresponding application No. PCT/JP2008/061906, completed Jul. 17, 2008, mailed Jul. 29, 2008.

International Search Report, issued in corresponding application No. PCT/JP2008/061905, completed Sep. 25, 2008, mailed Oct. 7, 2008.

Katsuhiro Dohashi et al., "Development of Small-Sized Hard X-Ray Source using X-Band Linac," 27-th Linac Technology Research Meeting, 2002, pp. 1-3.

Exended European Search Report, completed on Aug. 18, 2011 and mailed on Sep. 6, 2011, in corresponding European Application No. 08790769.7.

Extended European Search Report, completed on Jul. 19, 2011 and mailed on Jul. 28, 2011, in corresponding European Application No. 08790767.1.

* cited by examiner

HIGH BRIGHTNESS X-RAY GENERATING DEVICE AND METHOD

This is a National Phase Application in the United States of International Patent Application No. PCT/JP2008/061904 filed Jul. 1, 2008, which claims priority on Japanese Patent Application No. 2007-175180, filed Jul. 3, 2007. The entire disclosures of the above patent applications are hereby incorporated by reference.

BACKGROUND OF THE INVENTION

1. Technical Field of the Invention

The present invention relates to a high brightness X-ray generator and a high brightness X-ray generating method by inverse Compton scattering.

2. Description of the Related Art

Synchrotron radiation light (SR light) is an X-ray generated during an orbit change in the case where an orbit of the electron beam accelerated at a speed close to the speed of light is changed by a strong magnet in an annular accelerator (a synchrotron). The SR light is an X-ray source (e.g., an X-ray intensity (a photon number): about $10^{14}$ photons/s, a pulse width: about 100 ps), which is incommensurably ($10^3$ times or more) intense as compared with the X-ray tube. The SR light is used in fields where a high X-ray intensity is required.

However, a synchrotron radiation light facility in which a synchrotron is used is a large-sized facility in which the synchrotron has a major axis of about 50 m or more and an orbit length reaches 100 m or more, and there is therefore a problem that the facility may not be easily introduced for research or medical treatment.

As means for generating an X-ray by a small-sized device, means capable of obtaining a quasi-monochromatic X-ray arisen from inverse Compton scattering by a collision between an electron beam and a laser beam is known (e.g., Non-Patent Documents 1 and 2).

As small-sized X-ray generating means by inverse Compton scattering, Patent Documents 1, 2 have already been disclosed.

In "Small-Sized X-Ray Generator" of Non-Patent Document 1, as illustrated in FIG. 1, an electron beam 62 accelerated by a small-sized accelerator 61 (an X-band acceleration tube) is allowed to collide with laser 63 to generate an X-ray 64. The electron beam 62 generated by an RF (Radio Frequency) electron gun 65 (a thermal RF gun) is accelerated by the X-band acceleration tube 61, and collides with the pulse laser beam 63. The hard X-ray 64 having a time width of 10 ns is generated by Compton scattering.

In this figure, reference numeral 51 denotes a power source, 52 denotes an a-magnet, 53 denotes a magnet, 54 denotes Q-magnets, 55 denotes a beam dump, 56 denotes a laser unit, 57 denotes a mirror, 58 denotes a lens, 59 denotes a laser dump, 60 denotes a synchronizer, and A denotes a collision point.

This device is miniaturized by using, as an RF, an X-band (11.424 GHz) corresponding to a frequency four times as high as that of an S-band (2.856 GHz) which is generally used in a linear accelerator, and it is predicted that the hard X-ray having, for example, an X-ray intensity (a photon number) of about $1\times10^9$ photons/s and a pulse width of about 10 ps will be generated.

In Non-Patent Document 2, as illustrated in FIG. 2, a collision rate is increased in a reaction area by confining and circulating laser light using a plurality of reflection mirrors.

"Laser Inverse Compton Light Generation Device" of Patent Document 1 has an object to generate short-wavelength light such as an X-ray or a y-ray using the effect of inverse Compton scattering.

Thus, in the device of this invention, as illustrated in FIG. 3, a laser inverse Compton light port 72 and a laser beam port 71 are installed at separate positions in a reaction portion 73.

"Laser Light Circulating Device and Laser Light Circulating Method" of Patent Document 2 has an object to concentrate the same laser light at the same laser light focusing point multiple times by confining and circulating the laser light within a predetermined optical path and easily and accurately performing fine adjustment a position of the laser light focusing point, thereby greatly increasing the efficiency of using the laser light.

Thus, as illustrated in FIG. 4, this invention introduces laser light 83 from an outside source, confines the laser light within a circulation path 85 for circulating the laser light, repeatedly passes the laser light through a laser light focusing point 89 within the circulation path, adjusts a position of the laser light focusing point, and concentrates the same laser light at the same laser light focusing point multiple times.

[Non-Patent Document 1]

"Development of Small-Sized Hard X-Ray Source using X-band Linac", 27-th Linac Technology Research Meeting, 2002, authored by Katsuhiro DOHASHI, et al.

[Non-Patent Document 2]

Yasuo SUZUKI and et al. "A NEW LASER MASS SPECTROMETRY FOR CHEMICAL ULTRATRACE ANALYSIS ENHANCED WITH MULTI-MIRROR SYSTEM (RIMMPA)", ANALITICAL SCIENCE 2001 Vol. 17 Supplement

[Patent Document 1]

Japanese Patent Application Laid-Open No. 2001-345503 titled "Laser Inverse Compton Light Generation Device"

[Patent Document 2]

Japanese Patent Application Laid-Open No. 2006-344731 titled "Laser Light Circulating Device and Laser Light Circulating Method"

As described above, there have been proposed various devices (e.g., Patent Document 1) that collide laser light with an electron beam to generate an X-ray by inverse Compton scattering. As a technique of increasing the brightness of generated X-rays so far, a technique of circulating and repeatedly colliding an electron ray or laser light in a closed space (e.g., Patent Document 2) has been proposed.

However, the devices in Non-Patent Document 2 and Patent Document 1 have a problem in that the efficiency of generating an X-ray (i.e., the efficiency of using laser light) is low since the electron beam does not head-on collide with the laser light.

On the other hand, the devices of Non-Patent Document 1 and Patent Document 2 may increase the efficiency of generating an X-ray since the electron beam head-on collides with the laser light. In this case, the amount of X-rays generated, that is, the intensity, is proportional to the number of collisions of the electron beam and the laser light per unit time when an electric current of the electron beam and a photon number of the laser light are uniform.

In the devices of Non-Patent Document 1 and Patent Document 2, the pulse width of the electron beam is, for example, several 100 ns to several 1000 ns, and the frequency is, for example, 10 Hz. The frequency 10 Hz of the electron beam may be easily increased to about 50 Hz by using the same device.

On the other hand, the pulse width of the laser light is, for example, about 10 ns in the case of Nd:YAG laser and the frequency is the same as that of the electron beam, for example, 10 Hz. However, since a facility such as a power source or the like differs greatly, it is usually difficult to increase the frequency of the laser light.

Thus, when aiming at an increase in the brightness of X-rays (i.e., an increase in an X-ray output) in the future, it is possible to increase the number of collisions per unit time by increasing the frequency of an electron beam and laser light, but it is expected that high cost will be required to manufacture a laser unit. It is expected that optical elements such as a mirror and a lens will require custom-made products corresponding to high output power and, of course, the costs will increase.

The present invention has been made to solve the above-described problems. That is, an object of the present invention is to provide a high brightness X-ray generator and a high brightness X-ray generating method capable of promoting an increase in X-ray brightness (i.e., an increase in an X-ray output) while suppressing an excessive increase in the cost of optical elements such as a laser unit, a mirror, and a lens.

SUMMARY OF THE INVENTION

According to the present invention, there is provided a high brightness X-ray generator for generating an X-ray by inverse Compton scattering by colliding an electron beam with pulse laser light, the generator comprising:

a plurality of pulse laser units which emits a plurality of pulse laser lights in predetermined periods;

an optical-path matching unit which matches optical paths of the plurality of pulse laser lights; and a timing control unit which controls timings of the optical-path matching unit and the pulse laser units, wherein the plurality of pulse laser lights is emitted from the same optical path at different timings.

According to a preferred embodiment of the present invention, the optical-path matching unit includes a polarization beam splitter which makes the match with an optical path of P-polarized light by directly passing pulse laser light as the P-polarized light and reflecting pulse laser light as S-polarized light in an orthogonal direction; and one of a polarization plane control element which directly passes the S-polarized light and converts the P-polarized light into S-polarized light to be passed and a polarization plane control element which directly passes the P-polarized light and converts the S-polarized light into P-polarized light to be passed.

Preferably, the polarization plane control element is a half-wavelength plate, which is controlled to rotate in an emission direction serving as an axial center, or a Pockels cell that is controlled by voltage application.

According to the present invention, there is provided a high brightness X-ray generating method for generating an X-ray by inverse Compton scattering by colliding an electron beam with pulse laser light, the method comprising:

a plurality of pulse laser units which emits a plurality of pulse laser lights in predetermined periods;

an optical-path matching unit which matches optical paths of the plurality of pulse laser lights; and a timing control unit which controls timings of the optical-path matching unit and the pulse laser units, wherein the plurality of pulse laser lights is emitted from the same optical path at different timings and synchronized with an electron beam, thereby making a head-on collision at the same position.

According to the device and method of the present invention described above, the plurality of pulse laser units is combined, thereby raising power of laser light per unit time and increasing the brightness of X-ray generated.

That is, pulse laser lights emitted from the plurality of pulse laser units at different timings correspond to one optical path by appropriately controlling a polarization plane by the optical-path matching unit. After the laser lights corresponding to the one optical path are overlapped, the laser lights may be adjusted to have the same polarization plane and may travel in the same circulation path.

According to the present invention, a repeat frequency of effective laser pulse light may be increased using commercially available products without the use of custom-made products and power per unit time may be raised. Thereby, the frequency of collisions between laser light and electrons may be raised at a relatively low cost, thereby increasing the brightness of X-rays generated.

DESCRIPTION OF THE PREFERRED EMBODIMENT

Figure 1:
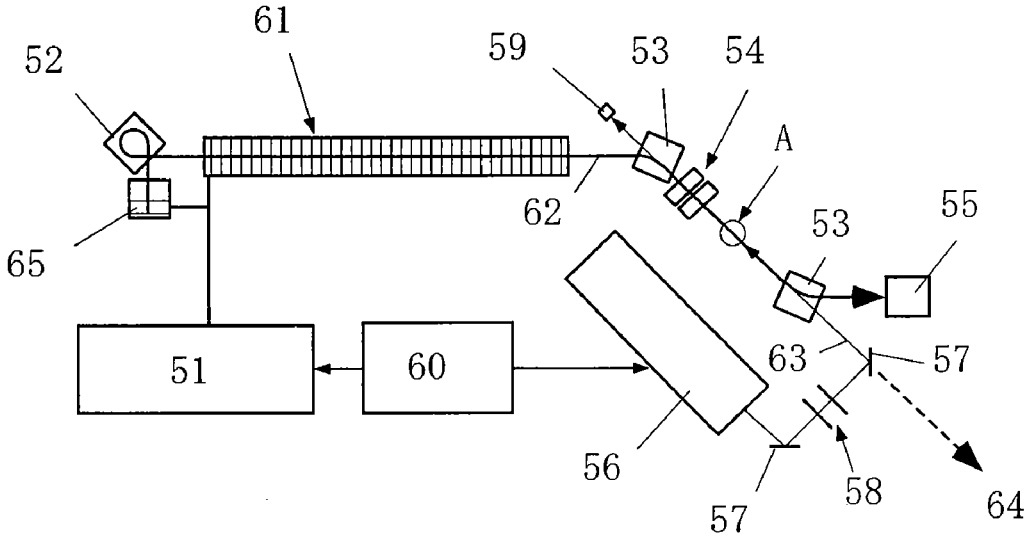
Fig. 1 Prior Art
FIG. 1 is a constitution diagram of "Small-Sized X-Ray Generator" of Non-Patent Document 1.
Figure 2:
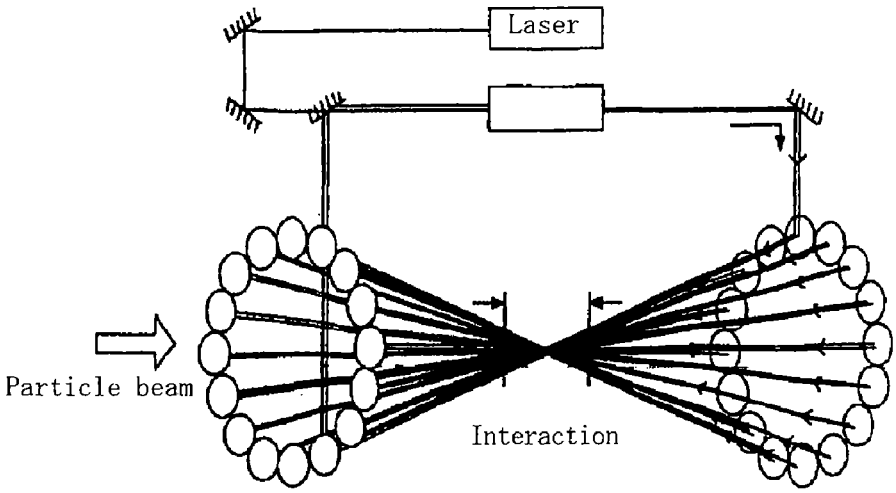
Fig. 2 Prior Art
FIG. 2 is a schematic diagram of a device of Non-Patent Document 2.
Figure 3:
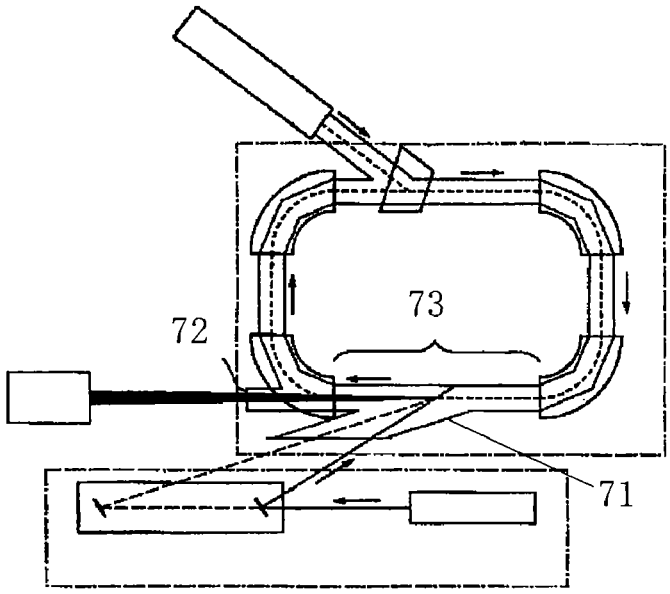
Fig. 3 Prior Art
FIG. 3 is a constitution diagram of "Laser Inverse Compton Light Generator" of Patent Document 1.
Figure 4:
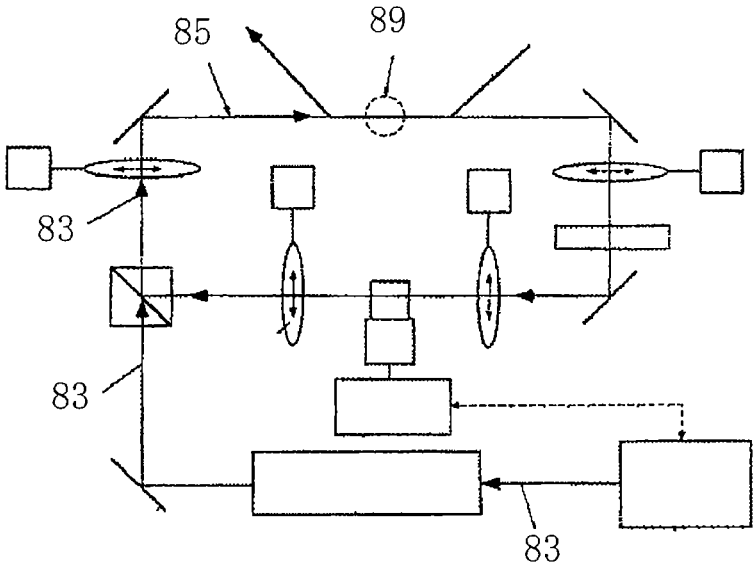
Fig. 4 Prior Art
FIG. 4 is a constitution diagram of "Laser Light Circulating Device and Laser Light Circulating Method" of Patent Document 2.

A preferable embodiment of the present invention will hereinafter be described with reference to the drawings. It is to be noted that, in the drawings, common parts are denoted by the same reference numerals, and redundant description thereof is omitted.

Figure 5:
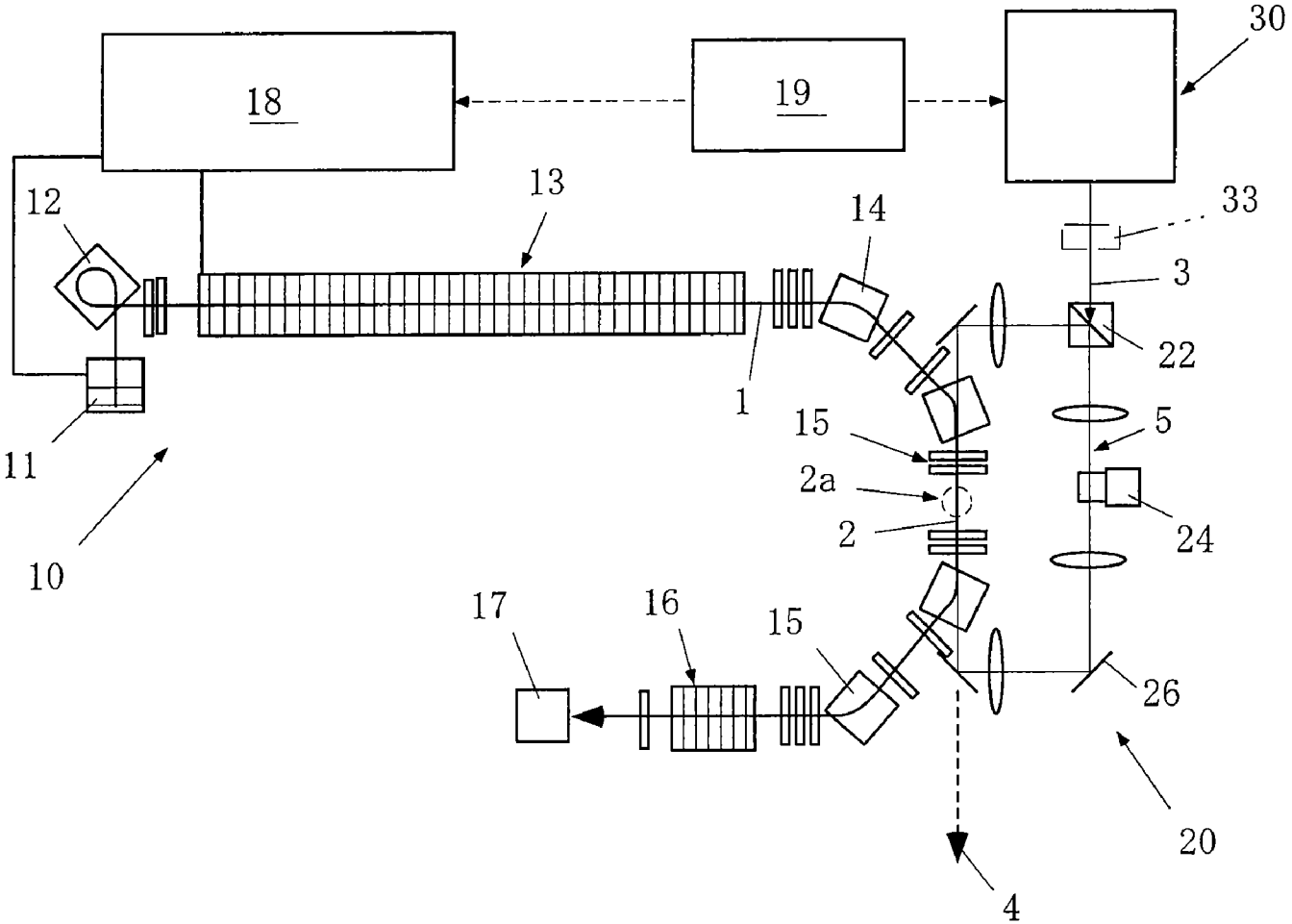
FIG. 5 is the whole constitution diagram of a high brightness X-ray generator according to the present invention.

FIG. 5 is the whole constitution diagram of a high brightness X-ray generator according to the present invention. The high brightness X-ray generator includes an electron beam generator 10, a laser light circulator 20, and a laser generator 30, and is a device that generates an X-ray by inverse Compton scattering by colliding an electron beam with pulse laser light.

The electron beam generator 10 has a function of generating a pulse electron beam 1 by accelerating an electron beam and passing the electronic beam through a predetermined rectilinear orbit 2.

In this example, the electron beam generator 10 includes an RF electron gun 11, an a-magnet 12, an acceleration tube 13, a bending magnet 14, Q-magnets 15, a deceleration tube 16, and a beam dump 17.

The RF electron gun 11 and the acceleration tube 13 are driven by a high-frequency power source 18 of an X-band (11.424 GHz). An orbit of the electron beam drawn from the RF electron gun 11 is changed by the a-magnet 12, and the beam then enters the acceleration tube 13. The acceleration tube 13 is a small-sized X-band acceleration tube, which accelerates the electron beam to generate a high-energy electron beam of preferably about 50 MeV. This electron beam is the pulse electron beam 1 of, for example, about 1 μs.

Especially, a large electron beam needs to be generated as compared with a laser light circulation time (about 20 ns) so that circulating laser light collides with one electron mass any number of times, and the pulse electron beam 1 may therefore be a multi-bunch pulse electron beam.

The bending magnet 14 bends the orbit of the pulse electron beam 1 with a magnetic field, passes the beam through the predetermined rectilinear orbit 2, and guides the passed pulse electron beam 1 to the beam dump 17. The Q-magnets 15 regulate a convergence degree of the pulse electron beam 1. The deceleration tube 16 decelerates the pulse electron beam 1. The beam dump 17 traps the pulse electron beam 1 passed through the rectilinear orbit 2 to prevent radiation leakage.

A synchronizer 19 controls the pulse electron beam 1 to collide with the pulse laser light 3 at a collision point 2*a* on the predetermined rectilinear orbit 2 by acquiring synchronization between the electron beam generator 10 and the laser generator 30 to synchronize the timing of the pulse electron beam 1 with the timing of the pulse laser light 3 described later.

By the electron beam generator 10 described above, the pulse electron beam 1 of, for example, about 50 MeV and about 1 μs may be generated and passed through the predetermined rectilinear orbit 2.

The laser light circulator 20 is adapted to repeatedly pass the pulse laser light 3 through the collision point 2*a* within a circulation path 5 by introducing the pulse laser light 3 from the external laser generator 30 into the circulation path 5 through a polarization beam splitter 22 and confining the pulse laser light 3 within the circulation path 5 for circulating the pulse laser light.

In this figure, the laser light circulator 20 includes the polarization beam splitter 22, three reflection mirrors 26, a Pockels cell 24, and a control unit (not shown).

The polarization beam splitter 22 directly passes first rectilinear polarization light 3*a* (P-polarized light) and perpendicularly reflects second rectilinear polarization light 3*b* (S-polarized light) orthogonal thereto.

The three reflection mirrors 26 constitute the circulation path 5, which circulates the pulse laser light 3 to the polarization beam splitter 22, by reflecting the pulse laser light 3 output from the polarization beam splitter 22 multiple times (three times in this example).

The Pockels cell 24 is placed at a downstream side of the polarization beam splitter 22 within the circulation path 5 and rotates a polarization direction of polarized light, passing therethrough upon voltage application, by 90 degrees. The Pockels cell is non-linear optical crystal capable of quickly switching a polarization direction of a light beam.

The control unit (not shown) controls the Pockels cell 24 so that the pulse laser light 3 constantly becomes the second rectilinear polarized light 3*b* (S-polarized light) circulated and input to the polarization beam splitter 22.

Figure 6:
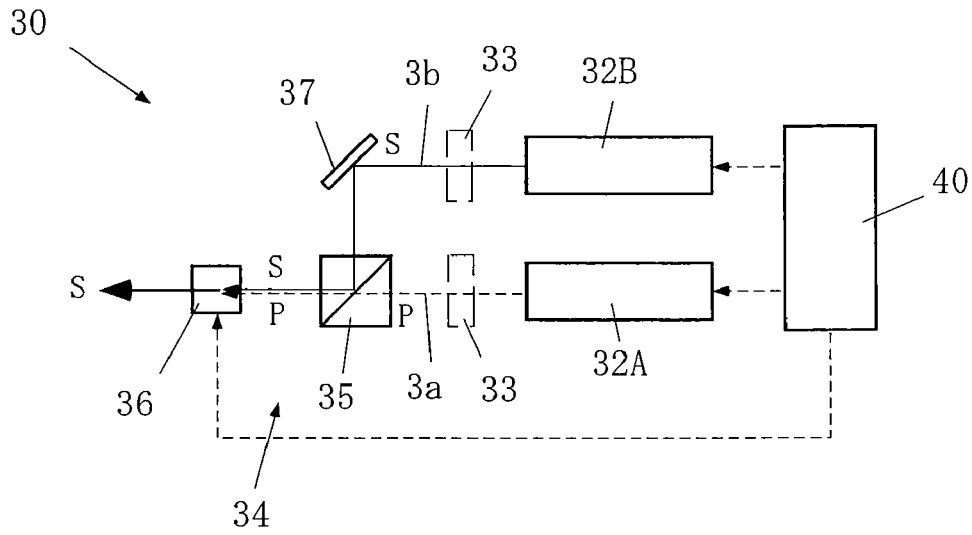
FIG. 6 is a diagram of a first embodiment of a laser generator.

FIG. 6 is a diagram of a first embodiment of the laser generator 30. In this figure, the laser generator 30 includes two pulse laser units 32A, 32B, an optical-path matching unit 34, and a timing control unit 40.

The two pulse laser units 32A, 32B respectively emit pulse laser lights 3*a*, 3*b* in predetermined periods. The pulse laser light 3*a* is the first rectilinear polarized light 3*a* (P-polarized light), and the pulse laser 3*b* is the second rectilinear polarized light 3*b* (S-polarized light). By rotating a polarization plane using a wavelength plate 33, the P-polarized light may be converted into the S-polarized light, or the S-polarized light may be converted into the P-polarized light.

The optical-path matching unit 34 includes a polarization beam splitter 35, a polarization plane control element 36, and a reflection mirror 37, and has a function of matching optical paths of the two pulse laser lights 3*a*, 3*b*.

The polarization beam splitter 35 makes the match with an optical path of the P-polarized light by directly passing the pulse laser light 3*a* as the P-polarized light and reflecting the pulse laser light 3*b* as the S-polarized light in an orthogonal direction.

The polarization plane control element 36 has a function of directly passing S-polarized light and converting P-polarized light into S-polarized light to be passed.

The polarization plane control element 36 is, for example, a half-wavelength plate, which is controlled to rotate in an emission direction serving as an axial center.

The polarization plane control element 36 may be a Pockels cell to be controlled by voltage application.

The timing control unit 40 controls the emission timings of laser lights of the pulse laser units 32A, 32B and the timing of converting the P-polarized light of the polarization plane control element 36 into S-polarized light.

The timing control unit 40 controls the timings of the pulse laser units 32A, 32B and the optical-path matching unit 34 so that the two pulse laser lights are emitted from the same optical path at different timings.

Figure 7:
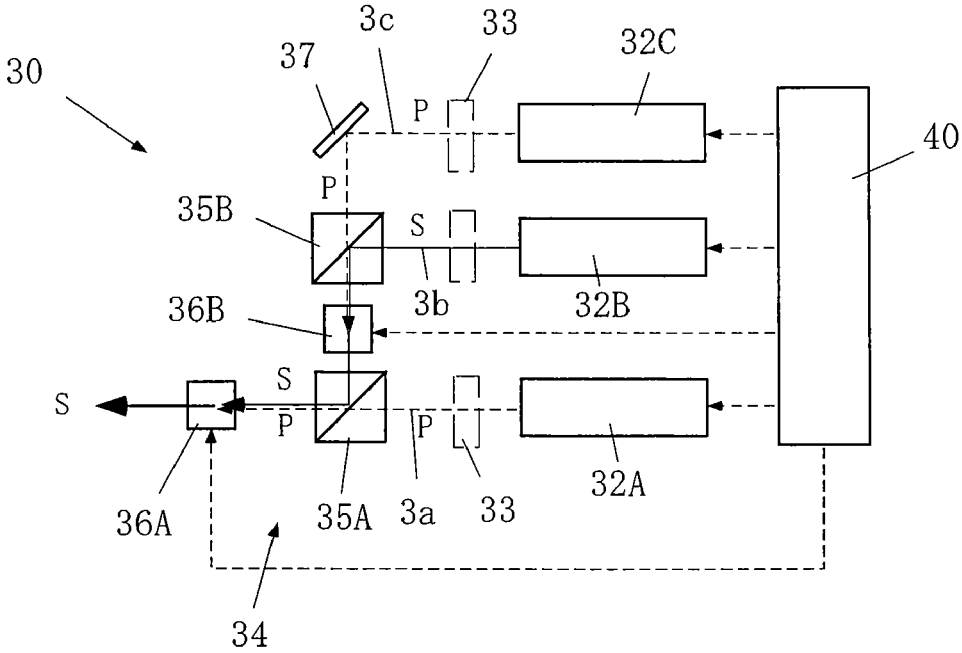
FIG. 7 is a diagram of a second embodiment of the laser generator.
Figure 8:
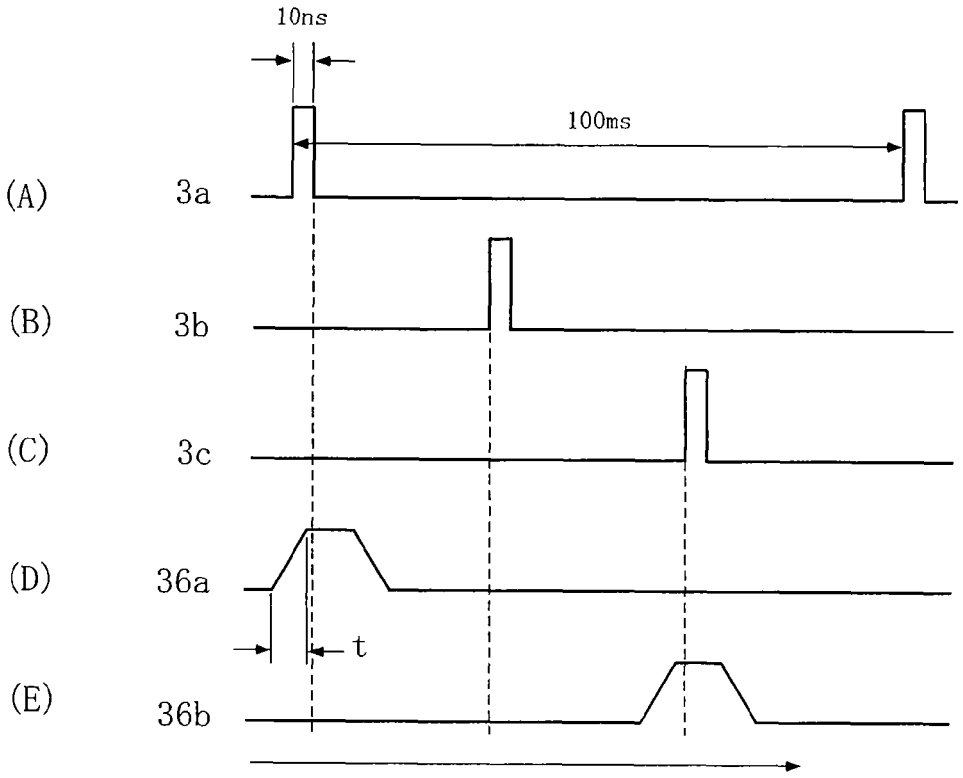
FIGS. 8A to 8E are timing diagrams illustrating control contents by a timing control unit.

FIG. 7 is a diagram of a second embodiment of the laser generator 30. In this figure, the laser generator 30 includes three pulse laser units 32A, 32B, 32C, an optical-path matching unit 34, and a timing control unit 40.

The three pulse laser units 32A, 32B, 32C respectively emit pulse laser lights 3*a*, 3*b*, 3*c* in predetermined periods. The pulse laser lights 3*a*, 3*c* are the first rectilinear polarized light 3*a* (P-polarized light), and the pulse laser 3*b* is the second rectilinear polarized light 3*b* (S-polarized light). By rotating a polarization plane using a wavelength plate 33, the P-polarized light may be converted into the S-polarized light or the S-polarized light may be converted into the P-polarized light.

The optical-path matching unit 34 includes two polarization beam splitters 35A, 35B, two polarization plane control elements 36A, 36B, and a reflection mirror 37, and has a function of matching optical paths of the three pulse laser lights 3*a*, 3*b*, 3*c*.

The polarization beam splitters 35A, 35B make the match with the optical path of the P-polarized light by directly passing the pulse laser light 3*a* as the P-polarized light and reflecting the pulse laser light 3*b* as the S-polarized light in an orthogonal direction.

The polarization plane control elements 36A, 36B have a function of directly passing the S-polarized light and converting the P-polarized light into S-polarized light to be passed.

The polarization plane control elements 36A, 36B are, for example, half-wavelength plates, which are controlled to rotate in an emission direction serving as an axial center, and may be Pockels cells to be controlled by voltage application.

The timing control unit 40 controls the emission timings of laser lights of the pulse laser units 32A, 32B, 32C and the timing of converting the P-polarized lights of the polarization plane control elements 36A, 36B into S-polarized lights.

The timing control unit 40 controls the timings of the pulse laser units 32A, 32B, 32C and the optical-path matching unit 34, so that the three pulse laser lights are emitted from the same optical path at different timings.

FIGS. 8A to 8E are timing diagrams illustrating control contents by the timing control unit 40.

In this example, when the pulse widths of the three pulse laser lights 3*a*, 3*b*, 3*c* are about 10 ns and the frequencies are 10 Hz, a pulse interval of each pulse laser light becomes 100 ms. Switching times t of the polarization plane control elements 35A, 35B are, for example, several ns to several 10 ms.

Accordingly, as illustrated in these figures, the timing control unit 40 controls the timings of the pulse laser units 32A, 32B, 32C and the optical-path matching unit 34 so that the three pulse laser lights 3*a*, 3*b*, 3*c* may be emitted from the same optical path at different timings.

Using the above-described device, the method of the present invention emits multiple (two or more) pulse laser lights from the same optical path at different timings, thereby synchronizing and head-on colliding the laser lights with an electron beam at the same position.

As described above, a frequency of the electron beam may be easily increased to about 50 Hz by the same device.

Accordingly, the method of the present invention may promote an increase in X-ray brightness (i.e., an increase in an X-ray output) while suppressing an excessive increase in the cost of optical elements such as a laser unit, a mirror, and a lens by substantially increasing the frequency of the laser light by at least twice.

It is to be noted that the present invention is not limited to the above embodiments, and needless to say, the present invention may be variously modified without departing from the scope of the present invention.

The invention claimed is:

1. A high brightness X-ray generator for generating an X-ray by inverse Compton scattering by colliding an electron beam with pulse laser light, the generator comprising:

(a) a plurality of pulse laser units that emit a plurality of pulse laser lights in predetermined periods;

(b) an optical-path matching unit that matches optical paths of the plurality of pulse laser lights;

(c) a timing control unit that is disposed to control timings of the optical-path matching unit and the plurality of pulse laser units, wherein the plurality of pulse laser lights is emitted from a same optical path at different timings;

(d) a polarization beam splitter that makes a match with an optical path of P-polarized light by directly passing pulse laser light as the P-polarized light and reflecting pulse laser light as S-polarized light in an orthogonal direction; and (e) a polarization plane control element selected from the group consisting of a first polarization plane control element disposed to directly pass the S-polarized light and to convert the P-polarized light into S-polarized light that is passed, and a second polarization plane control element disposed to directly pass the P-polarized light and to convert the S-polarized light into P-polarized light that is passed.

2. The high brightness X-ray generator according to claim 1, wherein the first polarization plane control element is a half-wavelength plate that is controlled to rotate in an emission direction serving as an axial center, or is a Pockels cell that is controlled by voltage application.

3. The high brightness X-ray generator according to claim 2, wherein the second polarization plane control element is a half-wavelength plate that is controlled to rotate in an emission direction serving as an axial center, or is a Pockels cell that is controlled by voltage application.

4. The high brightness X-ray generator according to claim 1, wherein the second polarization plane control element is a half-wavelength plate that is controlled to rotate in an emission direction serving as an axial center, or is a Pockels cell that is controlled by voltage application.

5. The high brightness X-ray generator according to claim 1, wherein the generator includes both the first polarization plane control element and the second polarization plane control element.

6. A high brightness X-ray generating method for generating an X-ray by inverse Compton scattering by colliding an electron beam with pulse laser light, the method comprising the steps of:

(a) emitting a plurality of pulse laser lights in predetermined periods using a plurality of pulse laser units;

(b) matching optical paths of the plurality of pulse laser lights using an optical path matching unit;

(c) controlling timings of the optical-path matching unit and the pulse laser units using a timing control unit, wherein the plurality of pulse laser lights is emitted from a same optical path at different timings and synchronized with an electron beam, thereby making a head-on collision at a same position; and (d) making a match with an optical path of P-polarized light by using a polarization beam splitter to directly pass pulse laser light as the P-polarized light and to reflect pulse laser light as S-polarized light in an orthogonal direction, wherein either a first polarization plane control element directly passes the S-polarized light and converts the P-polarized light into S-polarized light that is passed, or a second polarization plane control element directly passes the P-polarized light and converts the S-polarized light into P-polarized light that is passed, or the first polarization plane control element directly passes the S-polarized light and converts the P-polarized light into S-polarized light that is passed and the second polarization plane control element directly passes the P-polarized light and converts the S-polarized light into P-polarized light that is passed.

* * * * *